US007123146B1

(12) United States Patent
Holzman

(10) Patent No.: US 7,123,146 B1
(45) Date of Patent: Oct. 17, 2006

(54) SECURITY METHOD FOR THEFT PRONE AREAS OF A RETAIL STORE

(75) Inventor: Thomas G. Holzman, Marietta, GA (US)

(73) Assignee: NCR Corporation, Dayton, OH (US)

( * ) Notice: Subject to any disclaimer, the term of this patent is extended or adjusted under 35 U.S.C. 154(b) by 119 days.

(21) Appl. No.: 10/947,700

(22) Filed: Sep. 23, 2004

(51) Int. Cl.
*G08B 13/14* (2006.01)

(52) U.S. Cl. ..... 340/568.1; 340/572.1

(58) Field of Classification Search ..... 340/568.1
See application file for complete search history.

(56) References Cited

U.S. PATENT DOCUMENTS 4,751,500 A * 6/1988 Minasy et al. ..... 340/572.8
5,151,684 A * 9/1992 Johnsen ..... 340/568.1
5,245,317 A * 9/1993 Chidley et al. ..... 340/571
6,313,745 B1 * 11/2001 Suzuki ..... 340/572.1
6,996,402 B1 * 2/2006 Logan et al. ..... 340/572.1
2002/0038267 A1 * 3/2002 Can et al. ..... 705/28
2004/0080421 A1 * 4/2004 Wunderlich ..... 340/573.4
2004/0145475 A1 * 7/2004 Greenberger ..... 340/572.1
2005/0012613 A1 * 1/2005 Eckstein et al. ..... 340/539.13
2005/0040950 A1 * 2/2005 Clucas ..... 340/572.1
2005/0190060 A1 * 9/2005 Clancy et al. ..... 340/572.9

* cited by examiner

*Primary Examiner*—Daniel Wu
*Assistant Examiner*—Eric M. Blount
(74) *Attorney, Agent, or Firm*—Paul W. Martin

(57) ABSTRACT

A security method for theft prone areas of a retail store which alerts store employees of possible theft situations. The security method includes controlling an RFID label reader adjacent an entrance to a monitored area to determine entry of an item bearing an RFID label into the monitored area and departure of the item from the monitored area, sensing entry of the item into the monitored area, and issuing an alert to store personnel.

23 Claims, 2 Drawing Sheets

SECURITY METHOD FOR THEFT PRONE AREAS OF A RETAIL STORE

BACKGROUND OF THE INVENTION

The present invention relates to security systems for stores and more specifically to a security method for theft prone areas of a retail store.

Certain areas of retail stores are particularly prone to shoplifting. These areas include restrooms and fitting rooms. By carrying merchandise into those rooms, shoppers can conceal merchandise with the intent not to pay for it. Many stores post signs indicating that merchandise belonging to the store may not be carried into restrooms. Stores often allow only a restricted number of items to be carried into a fitting room.

Current solutions involve assigning employees to monitor fitting rooms. However, the employees are sometimes called away from their stations to wait on other customers. This leaves the fitting rooms unsupervised and vulnerable to shoplifting.

Therefore, it would be desirable to provide an alternative security method for theft prone areas of a retail store.

SUMMARY OF THE INVENTION

In accordance with the teachings of the present invention, a security method for theft prone areas of a retail store is provided.

The security method includes controlling an RFID label reader adjacent an entrance to a monitored area to determine entry of an item bearing an RFID label into the monitored area and departure of the item from the monitored area, sensing entry of the item into the monitored area, and issuing an alert to store personnel.

It is accordingly an object of the present invention to provide a security method for theft prone areas of a retail store.

It is another object of the present invention to provide a security method that automatically identifies items that are taken into and out of theft prone areas by shoppers.

BRIEF DESCRIPTION OF THE DRAWINGS

Additional benefits and advantages of the present invention will become apparent to those skilled in the art to which this invention relates from the subsequent description of embodiments and the appended claims, taken in conjunction with the accompanying drawings, in which:

DETAILED DESCRIPTION

Figure 1:
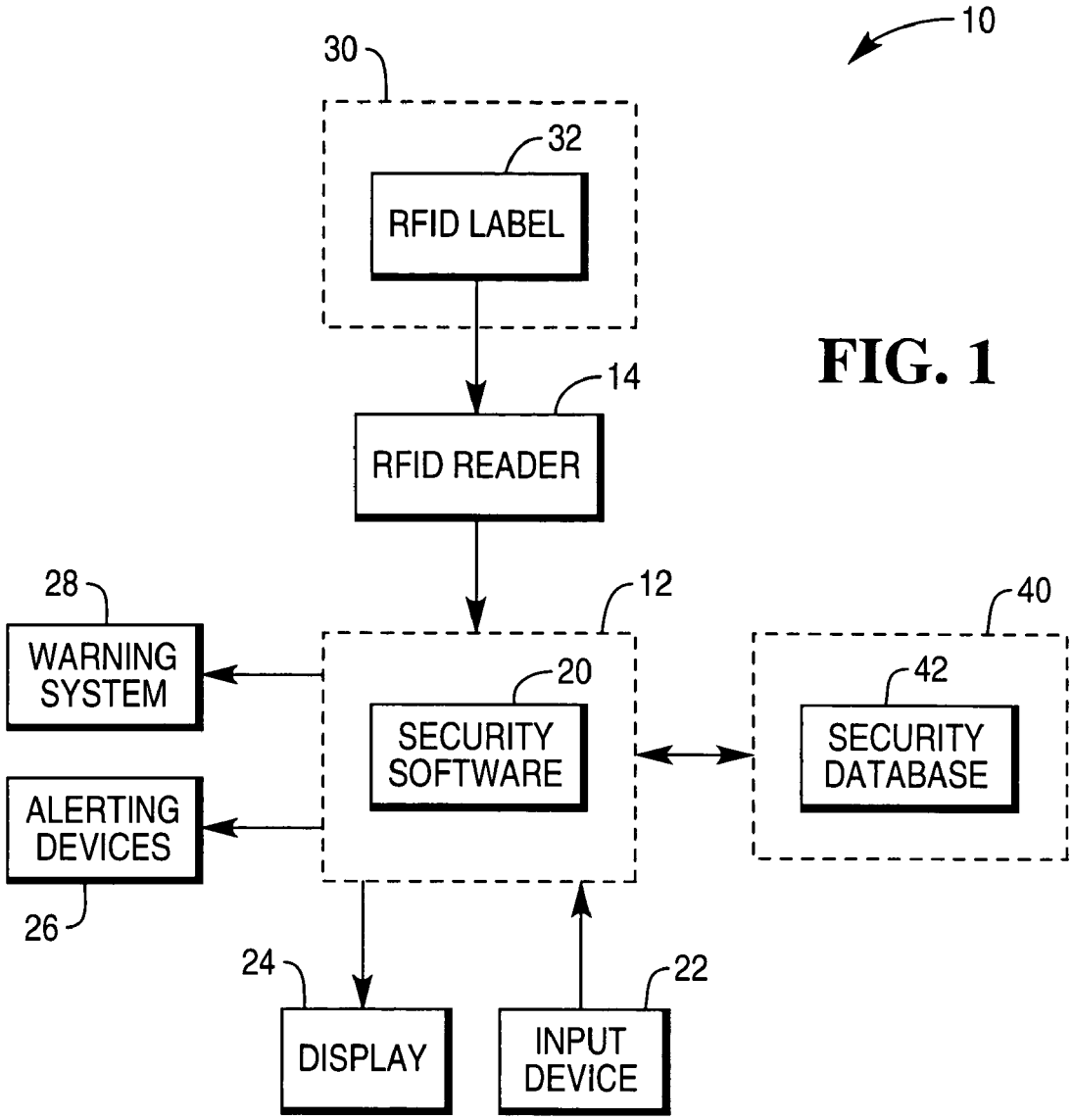
FIG. 1 is a block diagram of a security system.

Referring now to FIG. 1, security system 10 includes security computer 12 and RFID reader 14.

Security computer 12 executes security software 20, which receives RFID label information from RFID labels 32 on items 30. Security software 20 logs entry of items 30 into monitored areas which are prone to theft identifies items 30, and alerts store personnel to ensure that items 30 are visible when shoppers exit the monitored areas and to look for concealed items 30. The alerts identify items 30 that enter the monitored areas. Security software 20 may additionally log exit of items 30 from the monitored areas to provide store personnel with exit alerts.

Monitored areas may include areas such as dressing rooms in which items 30 are permitted, or areas such as restrooms where items 30 are not permitted. Security software 20 may determine the location of RFID reader 14 from security database 42 and determine when to issue an alert based upon the type of monitored area.

Security computer 12 may send the alerts to a variety of alerting devices 26. For example, security computer 12 may send the alerts to a point-of-sale terminal near the monitored areas, a security desk, or a personal digital assistant or cell phone carried by a security officer or store manager. Communication between security computer 12 and alerting devices 26 may be wired or wireless.

Security computer 12 may also display the alerts on display 24. Input device provides an operator with control over security software 20, including the capability to override alerts.

Security software 20 may additionally warn shoppers via warning system 28. Warning system 28 alerts shoppers that store personnel are monitoring movement of items 30 into and possibly out of certain areas of the store. Warning system 28 may include a speaker or display for presenting a visual or aural message to shoppers. The speaker or display may be mounted at the entrance to the monitored areas.

Warning system 28 may provide different types of alerts for different store areas. For example, warning system 28 may tell shoppers that items 30 are not permitted in restrooms.

For fitting rooms, warning system 28 may tell shoppers that items 30 were detected as they entered the fitting rooms and that trying on items 30 was permissible, but that the shoppers should carry the same items 30 out of the fitting room to avoid a security alert. Displays may be located in the fitting rooms for greater viewing privacy for items 30 the shopper is carrying.

RFID readers 14 may be mounted adjacent the entrances to the theft prone areas.

RFID labels 32 may be visible or hidden when attached to items 30. RFID labels 32 may be active or passive RFID labels. RFID reader 14 may either obtain item identification information directly from RFID labels 32, or from security database. In the latter case, RFID label reader 14 obtains a unique signature from RFID labels 32, which security software 20 compares to a table of item identifications in security database 42 to identify items 30. Security database 42 may include or be part of a price look-up database.

Server 40 stores security database 42. Server 40 and security computer 12 may be connected via a store network.

Figure 2:
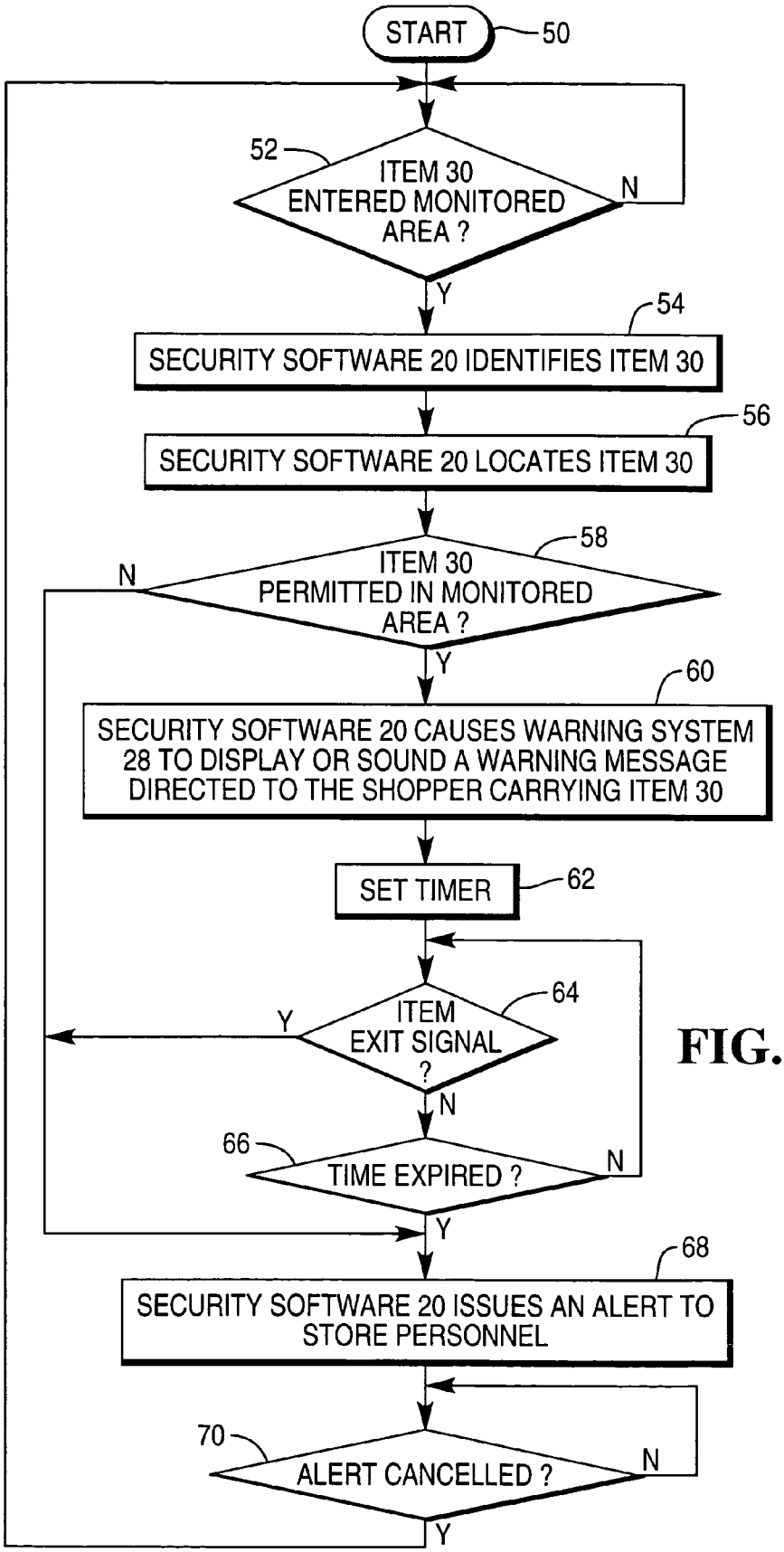
FIG. 2 is a flow diagram illustrating operation of the security system.

Turning now to FIG. 2, operation of security software 20 is illustrated in detail beginning with Start 50.

In step 52, security software 20 waits for an indication from RFID reader 14 that item 30 has entered a monitored area. If security software 20 receives RFID label information from RFID label 32, operation proceeds to step 54.

In step 54, security software 20 identifies item 30, either directly from RFID label 32, or indirectly by looking up item identification information in security database 42.

In step 56, security software 20 locates item 30 by locating RFID label reader 14 from security database 42.

In step 58, security software 20 determines whether item 30 is permitted in the determined location. If not, operation proceeds to step 66. Otherwise, operation continues to step 60.

In step 60, security software 20 causes warning system 28 to display or sound a warning message directed to the shopper carrying item 30.

In step 62, security software 20 sets a timer to time a reasonable time period for being in the monitored area.

In step 64, security software 20 waits for an exit signal indicating that item 30 has exited a monitored area. If not, operation proceeds to step 66. Otherwise, operation proceeds to step 68.

In step 66, security software 20 waits for the time period to expire. If so, then operation proceeds to step 68. The shopper may have left the monitored area and weakened the ability of RFID label 32 to communicate with RFID reader 14.

In step 68, security software 20 issues an alert to store personnel.

In step 70, security software 20 automatically cancels alerts if items 30 detected entering the monitored area are also detected leaving the monitored area. Alternatively, security software 20 may be configured to allow store personnel to manually cancel the alerts, particularly if store personnel must intervene to stop a possible theft. Operation returns to step 52 to wait for another signal from RFID label reader 14.

Advantageously, security system 10 reduces shrinkage, and makes more efficient use of labor for monitoring theft-prone areas. It offers greater convenience for shoppers who want to use fitting rooms, but who don't want to wait for a security tag to be issued before they enter a fitting room. Finally, system 10 offers greater privacy and less embarrassment for shoppers.

Although the invention has been described with particular reference to certain embodiments thereof, variations and modifications of the present invention can be effected within the spirit and scope of the following claims.

What is claimed is:

1. A security method comprising:

a) controlling an RFID label reader adjacent an entrance to a monitored area to determine entry of an item bearing an RFID label into the monitored area and departure of the item from the monitored area;

b) sensing entry of the item into the monitored area;

c) timing a time period of reasonable time in the monitored area;

d) treating the item as having left the monitored area after expiration of the time period; and e) issuing an alert to store personnel.

2. The method of claim 1, further comprising:

d) determining a location of the RFID label reader.

3. The method of claim 1, further comprising:

d) determining that the item is permitted with the monitored area.

4. The method of claim 1, further comprising:

d) sensing departure of the item from the monitored area.

5. The method of claim 4, further comprising:

e) automatically canceling the alert message.

6. The method of claim 1, further comprising:

d) determining that the item is not permitted in the monitored area; and e) issuing an alert informing a shopper with the item that the item is not permitted in the monitored area.

7. The method of claim 1, wherein the monitored area comprises a dressing room.

8. The method of claim 1, wherein the monitored area comprises a restroom.

9. The method of claim 1, further comprising:

d) issuing an alert informing a shopper with the item that the item is being monitored.

10. A security method comprising:

a) controlling an RFID label reader adjacent to an entrance to a monitored area to determine entry of an item bearing an RFID label into the monitored area and departure of the item from the monitored area by a computer;

b) receiving a signal from the RFID label reader by a computer, indicating that the RFID label reader has sensed entry of the item into the monitored area;

c) determining whether the item is permitted in the monitored area by the computer; and d) if the item is not permitted in the monitored area, issuing an alert to store personnel to ask a person controlling the item to depart the monitored area with the item by the computer, and if the item is permitted in the monitored area, issuing an alert to store personnel to look for concealment of the item by the person when the person departs the monitored area by the computer.

11. The method of claim 10, further comprising:

e) determining that the RFID label reader is located adjacent the entrance to the monitored area by the computer; and f) determining whether the item is permitted in the monitored area based upon a location of the RFID label reader by the computer.

12. The method of claim 10, wherein step (d) comprises:

d-1) receiving an item departure signal from the RFID label reader by the computer, indicating that the RFID label reader has sensed departure of a permitted item from the monitored area; and d-2) issuing the alert in response to receipt of said item departure signal by the computer.

13. The method of claim 10, wherein step (d) comprises:

d-1) receiving an item departure signal from the RFID label reader by the computer, indicating that the RFID label reader has sensed departure of a permitted item from the monitored area; and d-2) cancelling the alert in response to receipt of said item departure signal by the computer.

14. The method of claim 10, wherein step (d) comprises:

d-1) timing a time period of reasonable time spent in the monitored area by a permitted item by the computer;

d-2) determining that an item departure signal has not been receiving from the RFID label within the time period by the computer, indicating that the RFID label reader has not sensed departure of the permitted item from the monitored area;

d-3) treating the permitted item as having left the monitored area after expiration of the time period by the computer; and d-4) issuing the alert in response to said expiration by the computer.

15. The method of claim 10, wherein step (d) comprises:

d-1) sending a message to the store personnel.

16. The method of claim 10, further comprising:

e) if the item is not permitted in the monitored area, issuing another alert by the computer, informing the person that the item is not permitted in the monitored area.

17. The method of claim 16, wherein step (e) comprises:

e-1) sounding a message to the shopper over a speaker in the monitored area.

18. The method of claim 16, wherein step (e) comprises:

e-1) displaying a message to the shopper on a display in the monitored area.

19. The method of claim 10, further comprising:

e) if the item is permitted in the monitored area, issuing another alert by the computer, informing the person that the item is being monitored.

20. The method of claim 19, wherein step (e) comprises:

e-1) sounding a message to the shopper over a speaker in the monitored area.

21. The method of claim 19, wherein step (e) comprises:

e-1) displaying a message to the shopper on a display in the monitored area.

22. The method of claim 10, wherein the monitored area comprises a dressing room.

23. The method of claim 10, wherein the monitored area comprises a restroom.

* * * * *

UNITED STATES PATENT AND TRADEMARK OFFICE

CERTIFICATE OF CORRECTION

PATENT NO. : 7,123,146 B1
APPLICATION NO. : 10/947700
DATED : October 17, 2006
INVENTOR(S) : T. Holzman It is certified that error appears in the above-identified patent and that said Letters Patent is hereby corrected as shown below:

Column 3, Line 48, after “permitted” delete “with” and insert --within--

Signed and Sealed this

Twenty-sixth Day of May, 2009

JOHN DOLL
*Acting Director of the United States Patent and Trademark Office*